United States Patent [19]

Braly et al.

[11] Patent Number: 4,611,962

[45] Date of Patent: Sep. 16, 1986

[54] CONTAINER CHASSIS BUNDLING SYSTEM

[76] Inventors: John L. Braly, 3826 231st SE., Issaquah, Wash. 98024; Randall W. Matthewson, 2239 32nd Ave., Longview, Wash. 98632

[21] Appl. No.: 592,461

[22] Filed: Mar. 22, 1984

[51] Int. Cl.[4] ..... B60P 3/07

[52] U.S. Cl. ..... 410/57; 410/82; 410/31; 410/77; 280/33.99 R; 280/401; 414/31

[58] Field of Search ..... 410/56, 57, 31, 33, 410/43, 82, 2, 3, 5, 4, 7, 156, 77, 19, 20; 414/31; 280/33.99 R, 33.99 A, 33.99 T, 401

[56] References Cited

U.S. PATENT DOCUMENTS

| | | | |
|---|---|---|---|
| 862,338 | 8/1907 | Kendrick | 410/4 X |
| 3,048,437 | 8/1962 | Linder | 410/4 |
| 3,066,619 | 12/1962 | Holland | 410/57 X |
| 3,370,550 | 2/1968 | Gutridge et al. | 410/82 X |
| 3,580,606 | 5/1971 | Wagner | 410/43 |
| 3,841,509 | 10/1974 | Chisum | 410/57 |
| 4,321,000 | 3/1982 | Novak | 410/82 X |

FOREIGN PATENT DOCUMENTS

| | | | |
|---|---|---|---|
| 215747 | 4/1967 | Sweden | 410/56 |

*Primary Examiner*—Robert B. Reeves
*Assistant Examiner*—Glenn B. Foster
*Attorney, Agent, or Firm*—Seed and Berry

[57] ABSTRACT

A container chassis bundling system uses permanently affixed clamps 14, 14*a*, 40, 42, 42*a*, or 42*b*, for example, placed on a container chassis 10 to interconnect container chassis into an integral stack of chassis. Usually, chassis are interconnected with corresponding twist-lock bayonets 18 and twist-lock receivers 12 between corresponding top surfaces of the chassis and either rail 42, 42*a*, or 42*b* or landing gear interconnections 14 or 14*a* between the rails on the bottom flanges of the other chassis. An axle clamp 40 may connect the axle of one chassis to the kingpin of another chassis. Rail clamps 42, 42*a*, or 42*b* may also be used to connect corresponding top surfaces.

9 Claims, 10 Drawing Figures

CONTAINER CHASSIS BUNDLING SYSTEM

TECHNICAL FIELD

The present invention relates to a stack of container chassis and to a method for stacking and interconnecting container chassis for shipment, and more particularly, to an improved container chassis having permanently affixed means for interconnecting the chassis with others in a stack.

BACKGROUND ART

Traditionally, container chassis are loosely bundled by piling one chassis atop one another and interconnecting them with chains, straps, or other banding to temporarily hold the chassis in place. Such an operation is labor intensive and is hazardous to the operators. Furthermore, the integrity of the bundles is at question because it is difficult to interconnect the chassis as rigidly as desirable. This invention improves on the method for stacking and interconnecting container chassis, and greatly improves the off-loading of containers. The bundling material can cost as much as $500/bundle, and is sometimes discarded after each trip. The system of the present invention reuses the clamping materials.

DISCLOSURE OF INVENTION

A method for stacking and interconnecting container chassis for shipment includes positioning an inverted first chassis atop a base chassis so that the front of the first chassis aligns with the back of the base chassis and interlocking the two chassis with suitable connectors which are permanently affixed to at least one chassis. The interlocking connectors generally include at least one twist-lock bayonet on one chassis and a corresponding twist-lock receiver on the other chassis. The twist-lock bayonet is inserted into the twist-lock receiver to lock the two chassis. Alternatively, the interlocking connectors may include (1) a rail clamp on one chassis which is wrapped about and connected with a corresponding rail flange on the other chassis, (2) an axle clamp on one chassis which is interconnected with the kingpin of the other chassis, or (3) a landing gear cross-brace rail clamp. Bundles of two or more chassis may be made using the present method and apparatus simply by alternately laying chassis either top-to-top or bottom-to-bottom and interconnecting them with twist locks, rail clamps, axle clamps, cross-brace rail clamps, or some combination thereof.

The system allows quick and easy interconnecting of chassis into an integral bundle which is readily transported. The invention allows for a standardized assembly of container chassis bundles and results in an efficient, strong assembly of the chassis for transshipment as an integral assembly. Accordingly, less labor is required in making and transporting the bundles. Materials are recycled at a significant economic savings. These novel features of the invention greatly increase the efficiency of shipping merchandise by container.

BEST MODE FOR CARRYING OUT THE INVENTION

Figure 1:
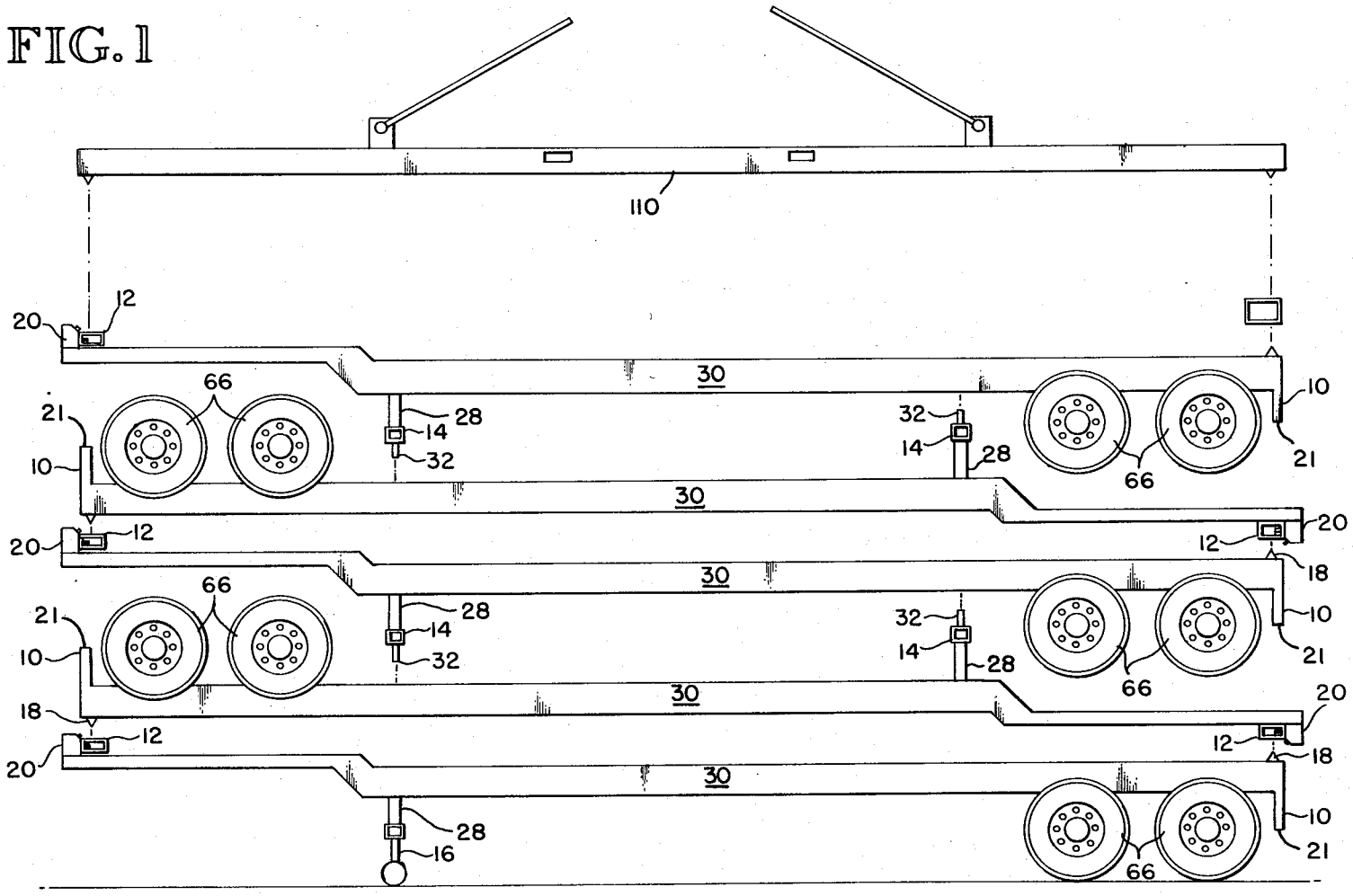
FIG. 1 is a schematic representation of a container chassis bundle having five chassis.

As shown schematically in FIG. 1, a stack of five container chassis 10 can readily be made by interlocking each chassis 10 with twist lock assemblies on the top of each chassis 10 and landing gear cross-brace rail clamps 14 associated with the landing gear 16. The bottom container chassis 10 receives an inverted chassis 10 which has its rear bolster abutting the front bolster of the base. The second chassis is inverted so that its wheels 66 project upwardly, and so its landing gear 16 extends upwardly. Four twist-lock bayonets 18 (two on the ends of each rear bolster 21) couple with twist-lock receivers 12 to secure the chassis together. A third container chassis 10 is then positioned above the second immediately above the first chassis so that its wheels 66 are essentially in vertical alignment with those of the first chassis. That is, this third chassis has its bottom in close proximity to the bottom of the second chassis and is substantially aligned with the first so that the front bolster 220 of the third chassis aligns with the rear bolster 21 of the second chassis. The second and third chassis are then interconnected by landing gear cross-brace rail clamps 14. Similarly, a fourth chassis is positioned atop the third in analogous fashion to the positioning of the second atop the first. Finally, in the five-high stack, as shown, a fifth chassis is positioned above the fourth analogously to that of the third chassis atop the second. A secure bundle is made which can be transported safely as a unit. The entire stack may be lifted as a unit, thereby easing handling of the stack.

Figure 2:
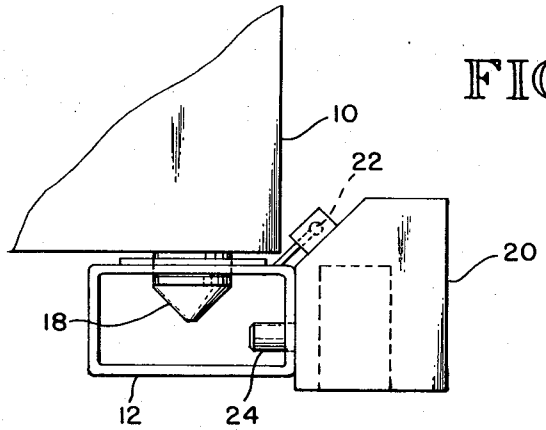
FIG. 2 is a typical detail of the interconnection of a twist lock and twist lock receiver.
Figure 7:
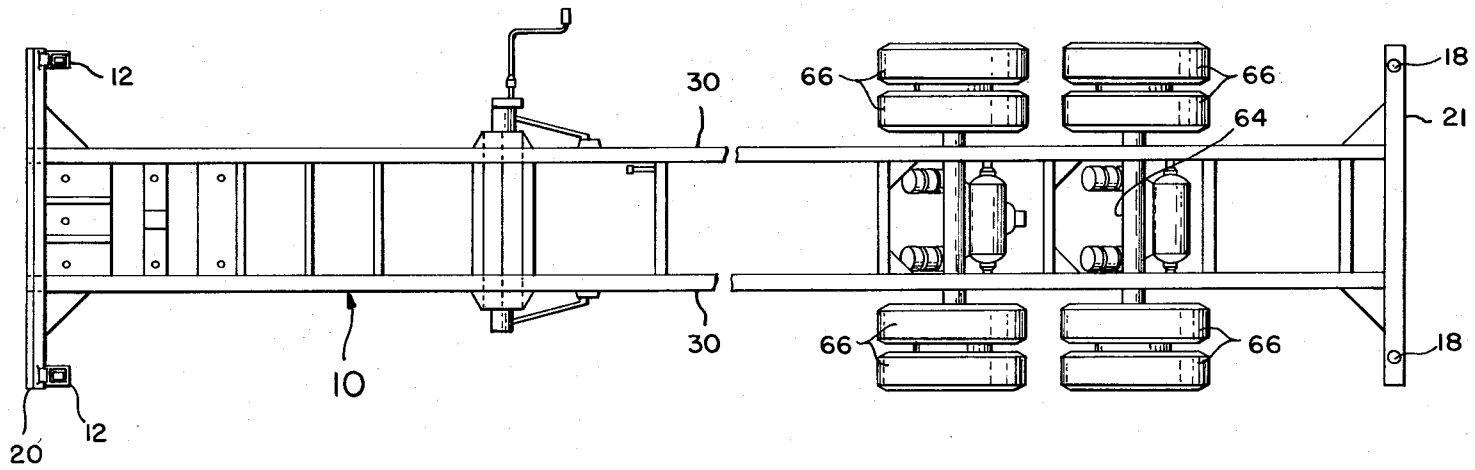
FIG. 7 is a top plan view of a typical container chassis showing the ordinary positioning of twist locks, bayonets, and twist-lock receivers.

The first and second chassis are interconnected at the respective front bolsters 20 with twist-lock receivers 12 and twist-lock bayonets 18, as is more clearly shown in FIG. 2. The twist-lock bayonets 18 are already positioned on the ends of the rear bolster of the container chassis for receiving a container for ordinary transit. The structure of the chassis is modified, as shown in FIG. 2, by adding a pivotable twist-lock receiver 12 on the front bolster 20 of the chassis or by building a twist-lock receiver directly into the front bolster 20, if feasible (not shown). The pivotable twist-lock receiver 12 is positionable either in a substantially horizontal plane, as shown in FIG. 2, or in a substantially vertical plane, pivoting around the pivot 22 to allow the connector pin 24 to be used to receive a container against the front bolster 20 of the chassis 10. That is, the receiver 12 flips out of the way when the chassis 10 is used to transport a container. As shown in FIG. 7, the twist-lock receivers 12 and twist-lock bayonets 18 are positioned near the ends of the bolsters 20 and 21 at the corners of the chassis.

Figure 3:
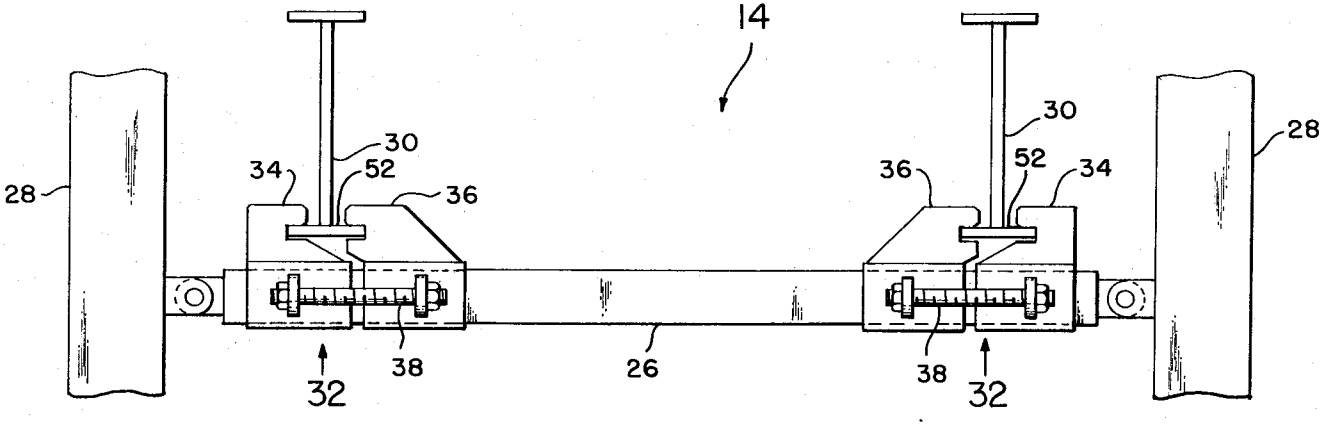
FIG. 3 is a detailed elevational view of a landing gear cross-brace rail clamp for interconnecting two chassis.

A typical landing gear cross-brace rail clamp 14 is shown in FIG. 3, where the cross-member 26 of the landing gear supports 28 includes clamp 32 which engage the rails 30 of the next adjacent chassis 10 in the stack. Each clamp 32 includes corresponding rail-engaging flanges 34 and 36, which are interconnected by a latching device, such as a trunnion 38. The trunnion 38 allows tightening of the flanges 34 and 36 about the flange 52 of the chassis rail 30. That is, by turning the threaded shaft of the trunnion 38, the corresponding flanges 34 and 36 of the clamp 32 may be moved together so that they engage and interlock with the flanges 52 of the rails 30. A simple and secure interconnection is readily achieved.

Thus, with a plurality of corresponding twist-lock bayonets 18 and twist-lock receivers 12, and landing gear cross-brace rail clamps 14, a stable and integral stack of chassis 10 may be easily constructed for transporting the empty chassis as a bundle. The necessary apparatus for making the sturdy, durable, and dependable interconnection of the chassis 10 is contained on each chassis and does not interfere with normal use of the chassis for hauling containers. Use of this bundling system does away with the cumbersome and labor-intensive task of interconnecting the chassis with chains, cables, or other means. The present invention provides a standardized location for and coupling between container chassis to allow durable, stable, and sturdy interconnection. With this invention, it is believed that a stack of five chassis may be used safely, while presently, with the existing cable and chain system, only a four-high stack may be legally transported. The ability to bundle five chassis at once will improve their transshipment, especially when the stack can be handled as a unit.

Figure 4:
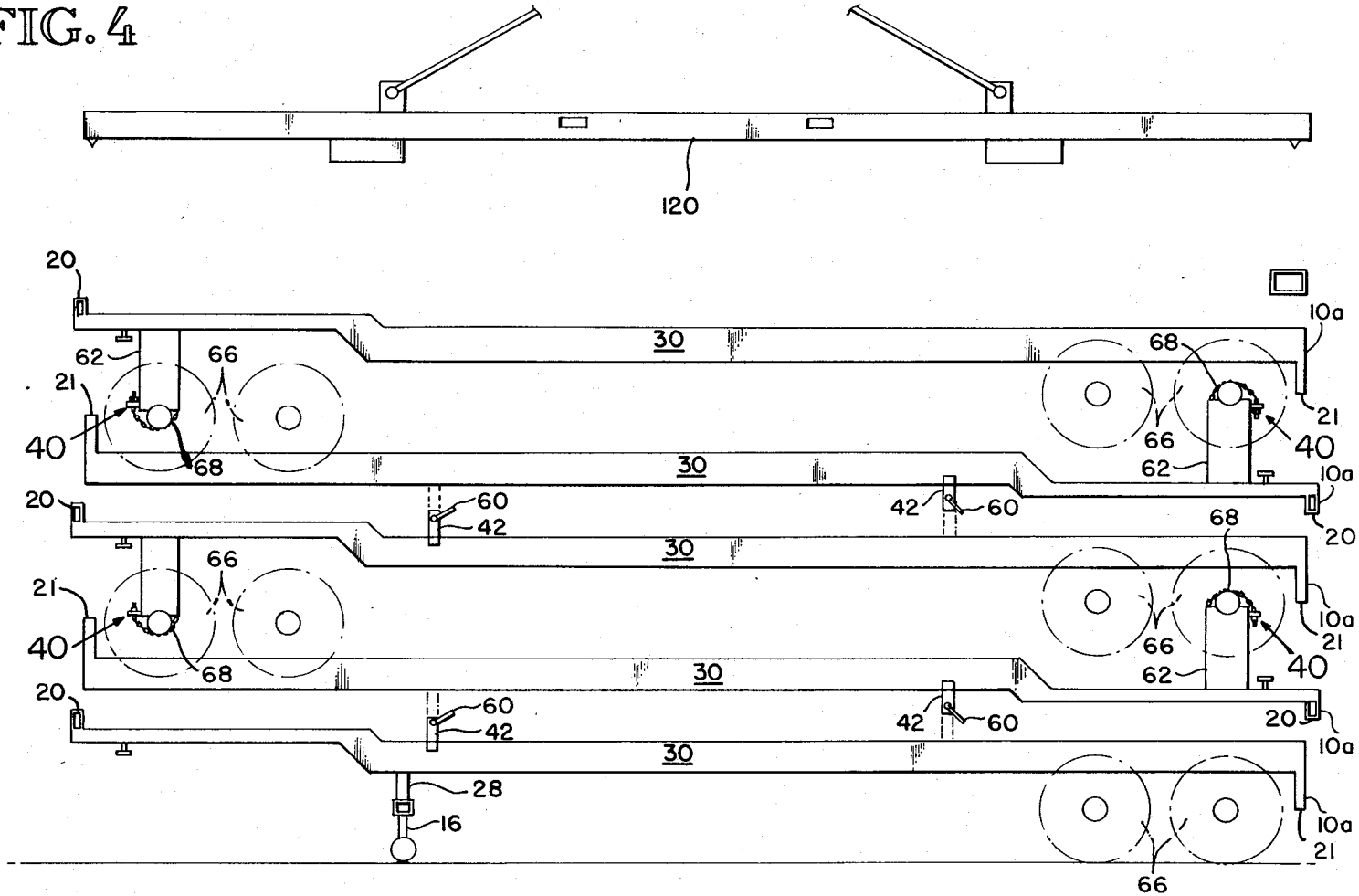
FIG. 4 is another schematic representation, similar to FIG. 1, of an alternative chassis bundle of the present invention and a bundle lifting apparatus.

As shown in FIG. 4, there are alternate embodiments for the inteconnection of chassis 10*a*. As with the stack of FIG. 1, however, five chassis 10*a* are interconnected by placing them in an alternating, inverted sequence, as previously described. Here, however, twist-lock receivers 12 and twist-lock bayonets 18 are not used, but instead, axle clamps 40 and rail clamps 42 are used. In the schematic of FIG. 4, the landing gear 16 for all but the bottom chassis have not been shown. Also, the standard twist-lock bayonets 18 (FIG. 1) have been omitted.

Figure 5:
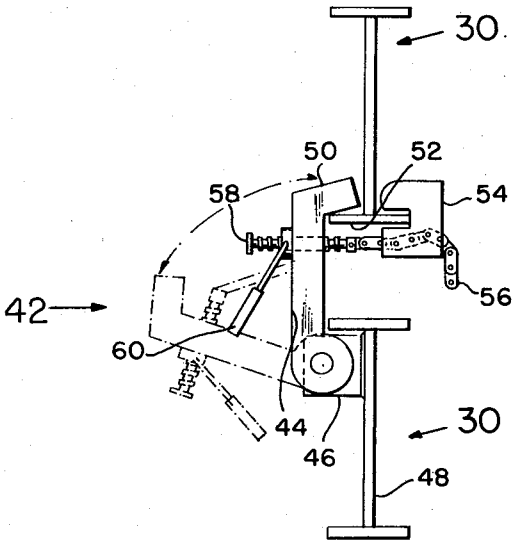
FIG. 5 is a detailed view of a rail clamp of the present invention.

A typical rail clamp 42 is shown in FIG. 5, where the clamp 42 includes a pivotable arm mounted to a plate 46 on the web 48 of a rail 30 of a first chassis 10*a*. The arm 44 is sufficiently long so that an ear 50 at the far end of the arm 44 can engage the flange 52 of the corresponding rail 30 for the next chassis 10*a* in the stack. A corresponding retainer 54 is interconnected to the arm 44 with a chain 56 allowing gross adjustment since the receiver 54 may slide on the chain 56 in one position and may be locked in a second position. A screw 58 at the arm 44 allows fine adjustment of the receiver 54 about the flange 52 of the rail by drawing the chain 56 relative to the arm 44. The screw 58 is turned with a handle 60 to draw the screw 58 inwardly to tighten the receiver 54 against the flange 52.

Figure 6:
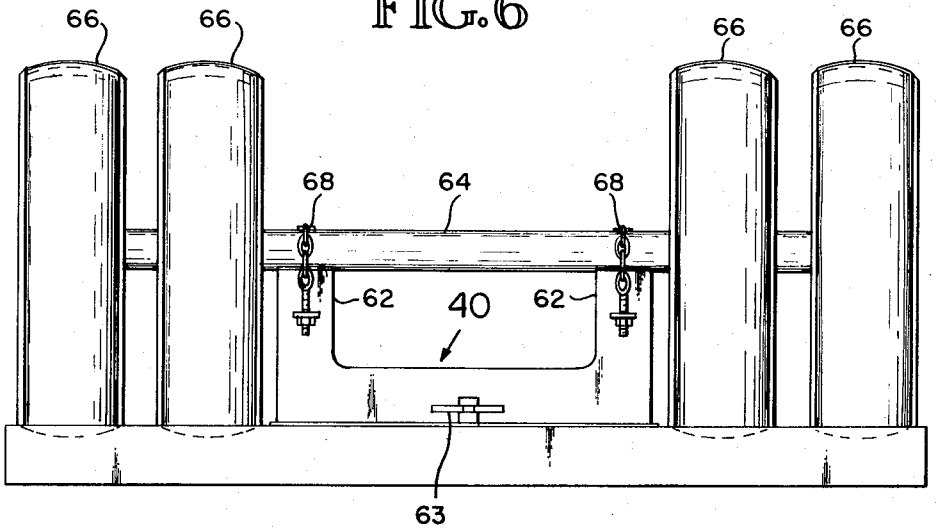
FIG. 6 is a detailed elevational view of an axle clamp of the present invention.

A typical axle clamp 40 is shown in FIG. 6, where the clamp 40 includes a saddle 62 on the kingpin 63 of one chassis. The saddle 62 engages the axle 64 of the associated chassis between the tires 66. A chain 68 can then be tightened around the axle 64 and connected to the saddle 62 so that the axle 64 engages the saddle 62 and is held securely.

Figure 8:
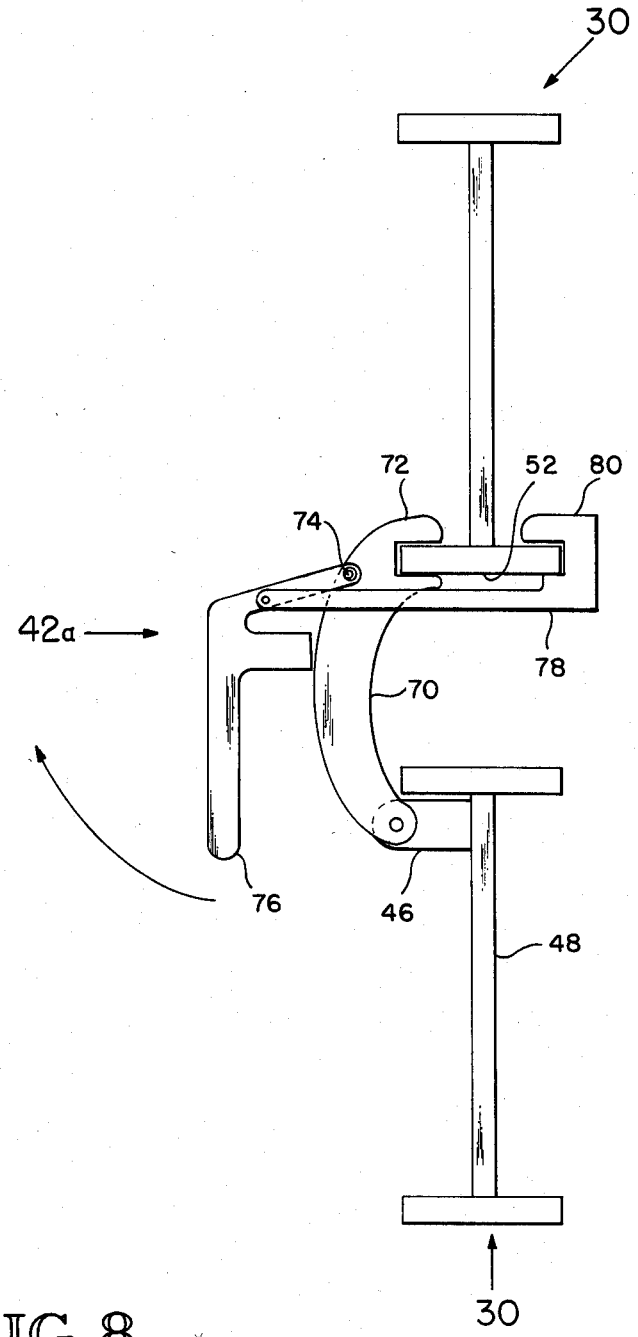
FIG. 8 is a detailed view of a preferred rail clamp of the present invention.

FIG. 8 shows an alternative clamp 42*a* of the present invention. As with the rail clamp 42 of FIG. 5, this rail clamp, 42*a* is pivotably connected to the web 48 of a lower rail 30 of a container chassis with a plate 46 that is welded or bolted to the web 48. The preferred rail clamp 42*a* has an arm 70 which has a flange-engaging, forked end 72. The arm 70 also includes a pivotal connection 74 for a bearing member 76 which is pivotally connected with a receiving arm 78. The receiving arm 78 clamps to the flange 52 with a corresponding flange-engaging end 80. The two flange-engaging ends 72 and 80 are quickly interconnected about the flange 52 and are held in position by the over-center clamp lever effect of the rail clamp 42*a* design. In operation, the flange-receiving end 72 of the arm 70 is positioned about the flange 52, while the flange-receiving portion 80 of the receiving arm 78 is loosely positioned about the respective flange. Then, the entire clamp 42 is tightened by pivoting the bearing member 76 about its pivotal connection 74 on arm 70. Thus, a very quick and simple clamp is provided. When not in use, the entire rail clamp 42*a* pivots downwardly against the web 48 of the corresponding container chassis.

Preferably, although not shown in this combination, a landing gear cross-brace rail clamp 14 and a rail clamp 42 are used together to interconnect chassis. This combination ensures a stable bundle and is the most universally applicable. Since there are many chassis designs (each just slightly different from the others), this combination of rail clamps seems to provide the greatest degree of flexibility.

Figure 9:
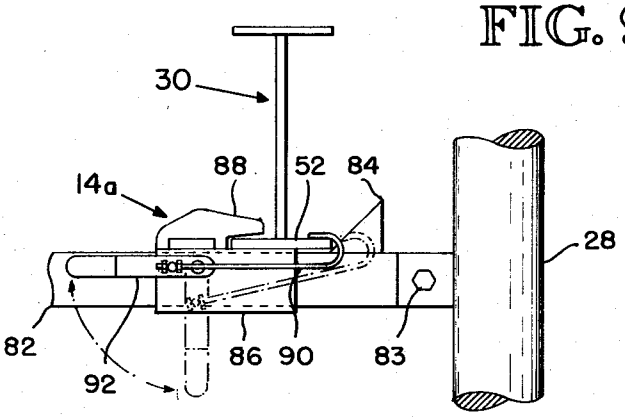
FIG. 9 is a detailed elevational view of a preferred landing gear cross-brace rail clamp, similar to that of FIG. 3.

A highly preferred landing gear cross-brace rail clamp 14*a* is shown in FIG. 9. A beam 82 extends between the landing gear supports 28 and is bolted to the landing gear brace attachment ears 83. The beam 82 generally is a hollow rectangular member having two telescoping segments interconnected to span between the supports 28. Stops 84 are fabricated onto the beam 82 near its ends. These stops 84 are outside the flange of the overlying chassis. The beam 82 supports sliding clamps 86 which can be moved so that a dog 88 overlies the flange 52 on the overlying chassis. A hook 90 may then be positioned over the opposite end of the flange 52 and a toggle 92 may be flipped to secure the clamp 86 to the rail 30.

For ease of installation and to accommodate different chassis widths, the beam 82 usually comes in separate sections so that the end tabs can be welded to the beam after being bolted to the supports 28.

Figure 10:
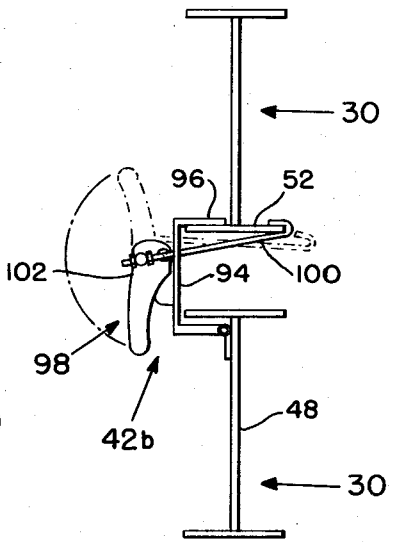
FIG. 10 is a detailed elevational view of a preferred rail clamp, similar to that of FIG. 6 or 8.

A highly preferred rail clamp 42*b* is shown in FIG. 10. This clamp 42*b* is pivotally mounted to the web 48 of a bottom rail 30 so that the body 94 of the clamp 42*b* can extend above the flange 52 of the overlying rail 30. The body 94 includes an inwardly projecting terminal portion 96 to overlie the rail flange 52 of the overlying chassis rail. A latch 98 mounted through a hole in the body 94 extends across the flange 52 to engage the opposite side of the flange 52 with a hook 100. A toggle 102 can be thrown to draw the hook 100 tight and a locking pin (not shown) can then be placed in the toggle 102 to keep it latched. When the clamp 42*b* is not in use to interconnect two chassis, it can be pivoted to extend outwardly from the web 48 below the flange and can be latched down to avoid any interference with use of the chassis.

FIGS. 1 and 4 show lifting frames 110 and 120, which can be connected to the upper chassis in the bundle to lift the entire bundle as a unit.

While preferred embodiments of the present invention have been shown and described, those skilled in the art will recognize modifications which might be made to the invention without departing from its inventive concept. For example, any combination of the interconnection devices can be used to securely fasten the adjacent tops and bottoms of adjacent chassis. Therefore, this description and the following claims are intended to be construed as liberally as possible to cover the concept of the invention, and the claims should not be limited to the specific embodiments unless such limitation is necessary in view of the pertinent prior art.

We claim:

1. A wheeled truck chassis for use with containers, the chassis having mechanisms for stacking a similar second chassis on the first, wherein the chassis is of the type having two spaced apart, longitudinally extending rails between the wheels wherein the front ends of the rails are connected by a transversely extending front bolster and the rear end of the rails are connected by a transversely extending rear bolster, the rear bolster having two upwardly extending twist-lock bayonets for the attachment of a container thereto and wherein the chassis also has at least one axle for the wheels wherein the axle is positioned between the bolsters and below the rails wherein the chassis also has a landing gear cross brace below the rails and between the front bolster and the axle, the mechanisms comprising:

two permanently attached twist-lock bayonet receivers on the front bolster for receiving the rear bayonets of the second chassis so that the rear bayonets of the first and second chassis are receivable in the bayonet receivers on the front bolsters when the chassis are stacked in a reversed, inverted relationship;

two sliding rail clamps permanently and slidably attached to the landing gear cross brace to adjust to the width of the rails on the second chassis and having means for receiving and fixing the rails of the second chassis in the sliding rail clamps and to the first chassis.

2. The truck chassis mechanisms of claim 1 wherein the bayonet receivers are pivotally connected to the front bolster to pivot out of the way of a container when it is desired to secure the container to the truck chassis.

3. The truck chassis mechanisms of claim 1 wherein the sliding rail clamps have stops permanently fixed to the landing gear cross brace and space apart sufficiently to closely receive the rails of the second chassis therebetween and wherein each clamp has a dog sized to overlay a flange portion of a rail on the second chassis and a hook connected to the dog by a toggle in an over center relationship so that operation of the toggle alternately secures and releases the flange portion of the second chassis contained in the sliding rail clamps.

4. A wheeled truck chassis for use with containers, the chassis having mechanisms for stacking a second chassis on the first, wherein the chassis are the type having two spaced apart, longitudinally extending rails wherein the front ends of the rails are connected by a transversely extending front bolster and the rear end of the rails are connected by a transversely extending rear bolster and wherein the chassis also has at least one axle for the wheels positioned between the bolsters and below the rails, a landing gear cross brace between the front bolster and the axle and a downwardly extending kingpin at the forward end of the chassis, the mechanisms comprising:

a removable axle saddle having means for releasably receiving a kingpin at one end and means for releasably receiving an axle at the opposite end for holding the axles of each chassis in a space relationship to the kingpins of each chassis when the chassis are stacked in a reversed, inverted relationship; and two fixed rail clamps each pivotally attached to one of each of the rails so as to be pivotally positionable between a first extended position for grasping the rails of the second chassis and second stored position.

5. The truck chassis mechanisms of claim 4 including two sliding rail clamps permanently and slidably attached to the landing gear cross brace to adjust to the width of the rails on the second chassis and having means for receiving and fixing the rails of the second chassis in the clamps and to the first chassis.

6. The truck chassis mechanisms of claim 5 wherein the sliding rail clamps have stops permanently fixed to the landing gear cross brace and spaced apart sufficiently to closely receive the rails of the second chassis therebetween and wherein each clamp has a dog sized to overlay a flange portion of a rail and a hook connected to the dog by a toggle in an over center relationship so that operation of the toggle alternately secures and releases the flange portion contained in the sliding rail clamps.

7. A method for stacking two or more wheeled truck chassis for use with containers, the chassis being of the type having two spaced apart, longitudinally extending rails between the wheels wherein the front ends of the rails are connected by a transversely extending front bolster and the rear end of the rails are connected by a transversely extending rear bolster having two upwardly extending twist-lock bayonets for the attachment of a container thereto and wherein the chassis also has at least one axle for the wheels positioned below the rails and a landing gear cross brace and below the rails and between the front bolster and the axle, comprising the following steps:

inverting and reversing the second truck chassis relative to the first chassis wherein the first chassis has its wheels on the ground;

securing the first chassis to the second chassis by securing twist-lock bayonets on the rear bolsters of the chassis with bayonet receivers on the front bolster end of each chassis and by further securing the chassis with fixed rail clamps between the rails, the fixed rail clamps being pivotal between a first extended position for grasping the rails of one chasis relative to the other and a second stored position; and placing a third chassis right side up on the second chassis and in the same orientation as the first chassis and interconnecting the second chassis to the third chassis by means of sliding rail clamps permanently and slidably attached to the landing gear cross braces of each chassis.

8. The method of claim 7 wherein the sliding rail clamps have stops permanently fixed to the landing gear cross brace and spaced apart sufficiently to closely receive the rails of the second chassis therebetween and wherein each clamp has a dog sized to overlay a flange portion of a rail and a hook connected to the dog by a toggle in an over center relationship so that operation of the toggle alternately secures and releases the flange portion contained in the sliding rail clamps, and wherein the fixed rail clamps have a terminal portion for grasping a flange portion of a rail and a latch connected to the fixed clamp by a handle in an over center relationship so that opertion of the handle alternately secures and releases the flange portion contained in the fixed rail clamps.

9. A method of stacking two or more wheeled chassis for use with containers, the chassis of the type having two spaced apart, longitudinally extending rails wherein the front ends of the rails are connected by a transversely extending front bolster and the rear end of the rails are connected by a transversely extending rear bolster and wherein the chassis also has at least one axle for the wheels positioned between the bolsters and below the rails, a landing gear cross brace between the front bolster and the axle and a downwardly extending kingpin at the forward end of the chassis, comprising the following steps:

stacking the second chassis on the first chassis wherein the first chassis has its wheels on the ground and by inverting and reversing the second chassis and placing the second chassis above the first chassis;

securing the second chassis to the first chassis by fixed rail clamps on each chassis wherein each of the rail clamps are pivotally attached to one of each of the rails so as to be pivotally positionable between a first extended position for grasping the rails of the second chassis and a second stored position; and stacking a third chassis on top of the second chassis in the same orientation as the first chassis by securing the axle of the second and third chassis to their respective kingpins by removable axle saddles having means for releasably receiving a kingpin at one end and means for releasably receiving an axle at the opposite end.

* * * * *